US005307078A

United States Patent [19]

Tanaka et al.

[11] Patent Number: 5,307,078

[45] Date of Patent: Apr. 26, 1994

[54] AM-FM-CELLULAR MOBILE TELEPHONE TRI-BAND ANTENNA WITH DOUBLE SLEEVES

[75] Inventors: Takayuki Tanaka; Shigeru Egashira; Akihide Sakitani, all of Saga; Kazuhisa Yoshiki, Osaka; Yoshimi Egashira, Kanagawa, all of Japan

[73] Assignee: Harada Kogyo Kabushiki Kaisha, Tokyo, Japan

[21] Appl. No.: 857,979

[22] Filed: Mar. 26, 1992

[51] Int. Cl.[5] ..... H01Q 9/38

[52] U.S. Cl. ..... 343/791; 343/828; 343/829

[58] Field of Search ..... 343/790, 791, 792, 749, 343/900, 715, 722, 828-831, 899; H01Q 9/04, 38, 9/16, 30, 5/00, 5/02, 21/30, 9/40

[56] References Cited

U.S. PATENT DOCUMENTS

| | | | |
|---|---|---|---|
| 3,139,620 | 6/1964 | Leidy et al. | 343/792 |
| 3,981,017 | 9/1976 | Kommrusch | 343/792 |
| 4,509,056 | 4/1985 | Ploussios | 343/791 |
| 4,937,588 | 6/1990 | Austin | 343/791 |

*Primary Examiner*—Michael C. Wimer
*Attorney, Agent, or Firm*—Koda and Androlia

[57] ABSTRACT

A tri-band antenna including an center conducting an inner pipe surrounding the center conductor, an outer pipe surrounding the inner pipe and Teflon provided between the inner and outer pipes.

2 Claims, 2 Drawing Sheets

AM-FM-CELLULAR MOBILE TELEPHONE TRI-BAND ANTENNA WITH DOUBLE SLEEVES

BACKGROUND OF THE INVENTION

1. Field of the Invention

This invention relates to cellular mobile antennas for vehicles.

2. Prior Art

For AM/FM B.C. and cellular mobile telephone (MT) in vehicles, more than two antennas are usually necessary. However, an AM-FM-MT tri-band antenna is desired and one with coils is used presently.

The tri-band antenna, as shown in FIG. 1 is usually connected to an AM/FM receiver and a mobile telephone receiver/transmitter via a branching filter. Transmission loss in the branching filter and the coaxial transmission line is about 1.5–2.0 dB in all. Therefore, it is desired that the tri-band antenna has a directive gain high enough to compensate for it's loss. In addition, the tri-band antenna is required to have a directivity broad enough to keep a sensitivity in the mobile telephone band even when the antenna inclines. The tri-band antenna referred to in this application is for U.S.A. (Transmitting frequency range of MT:825–845 MHz Receiving frequency range of MT:870–890 MHz, etc.).

SUMMARY OF THE INVENTION

The objects of the present invention are accomplished by an AM, FM and MT (Tri-band) antenna including a center, conductor, an inner pipe coaxial with and surrounding the center conductor, an outer, pipe coaxial with and surrounding the inner pipe and Teflon (polytetrafluoroethylene) provided between the inner and outer pipes.

DETAILED DESCRIPTION OF THE INVENTION

Figure 1:
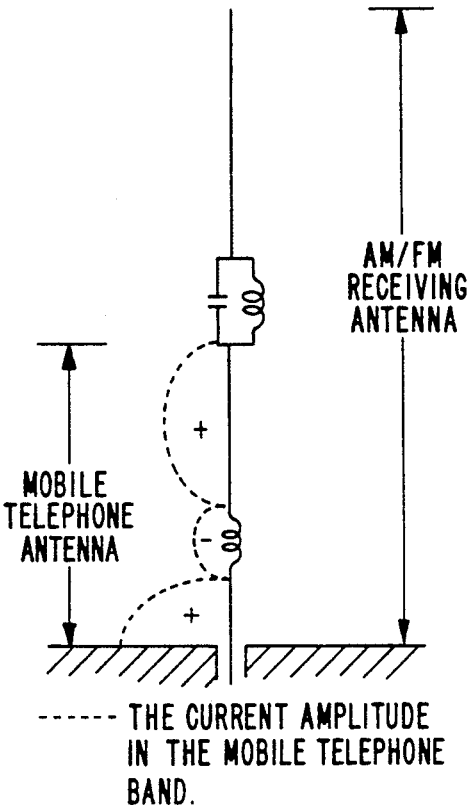
FIG. 1 is a collinear array antenna of the prior art.
Figure 2:
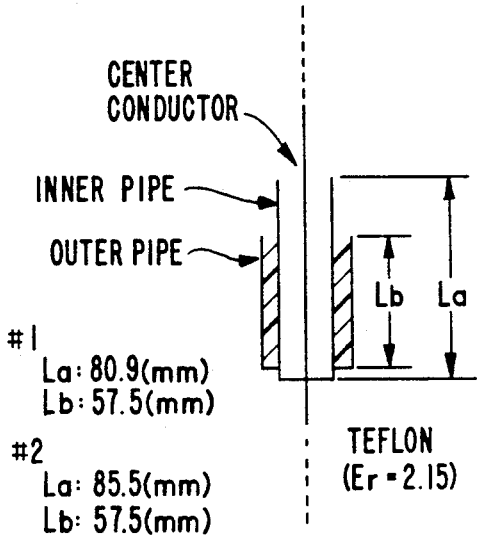
FIG. 2 is a tri-band antenna in accordance with the teachings of the present invention.

FIG. 2 shows a double sleeve used for the tri-band antenna. This consists of two metal pipes, Teflon (polytetrafluoroethylene) and a center conductor. The lower end of the inner pipe and the center conductor are shorted, and the lower end of the outer pipe and the inner pipe are also shorted. The space between the outer pipe and the inner pipe is filled with Teflon ($\epsilon\gamma=2.15$). In this application, we call the double sleeve of which the dimensions are illustrated in FIG. 2(#1) "sleeve 1" and the double sleeve of which the dimensions are illustrated in FIG. 2(#2) "sleeve 2".

Figure 3A:
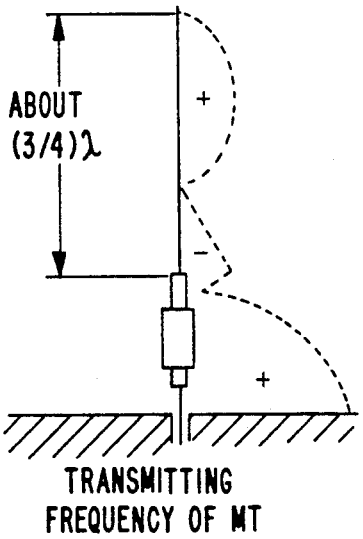
FIGS. 3(*a*) and 3(*b*) show the current distribution of the antenna of FIG. 2.
Figure 3B:
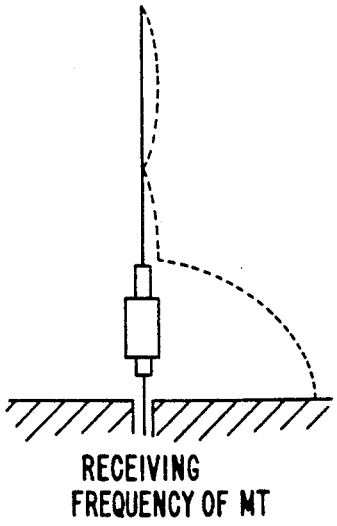

FIG. 3(*a*) and FIG. 3(*b*) show a wire antenna with the sleeve(#1). The dotted line indicates the current amplitude and the signs + indicate the phase of the current distribution. λ denotes a wavelength in the mobile telephone band. The wire antenna operates as a collinear array antenna in the transmitting frequency range of MT (FIG. 3(*a*)). In the receiving frequency range of MT, the current amplitude in the upper linear part than the sleeve #1 is very small (FIG. 3(*b*)).

Figure 4:
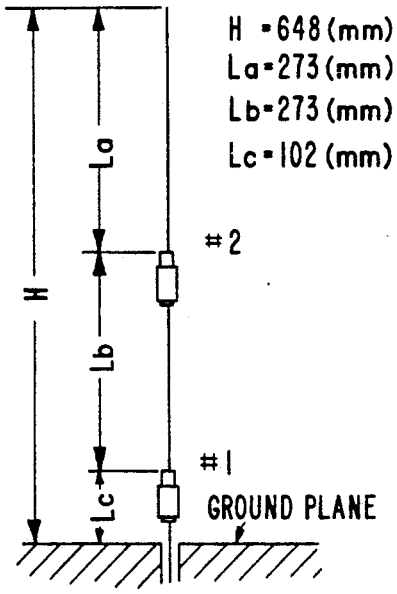
FIG. 4 shows a model antenna used in experiments.

As shown in FIG. 4, when the sleeve #2 is attached to the position where a current is nearly a local maximum on an antenna, the current amplitude is very small in the upper part than the sleeve #2 in the mobile telephone band.

In the AM/FM B.C. bands, the double sleeves scarcely influence the current distribution of the antenna.

FIG. 4 shows a model antenna. La and Lb are ($\frac{3}{4}\lambda$, and Lc is a little longer than λ/4 (λ denotes wavelength at 825 MHz). The sleeve 1 and the sleeve 2 are denoted by #1 and #2, respectively. It would also be possible to make La and Lb each equal to (N/4) λ where N is an odd integer, i.e., either La or Lb or both could be equal to (5/4)λ.

Figure 5A:
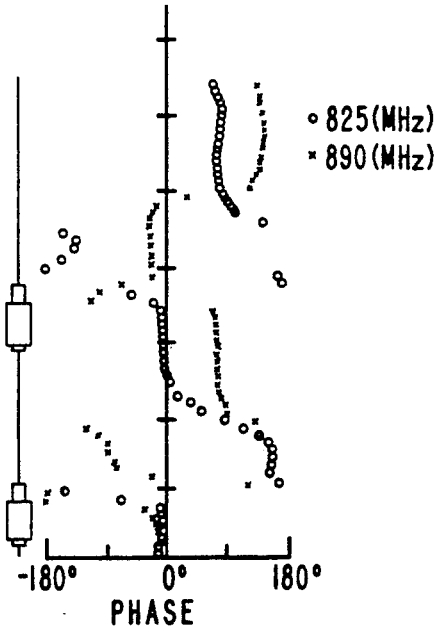
FIG. 5(*a*) and 5(*b*) respectively show the phase and amplitude the current distribution for the model antenna of FIG. 4.
Figure 5B:
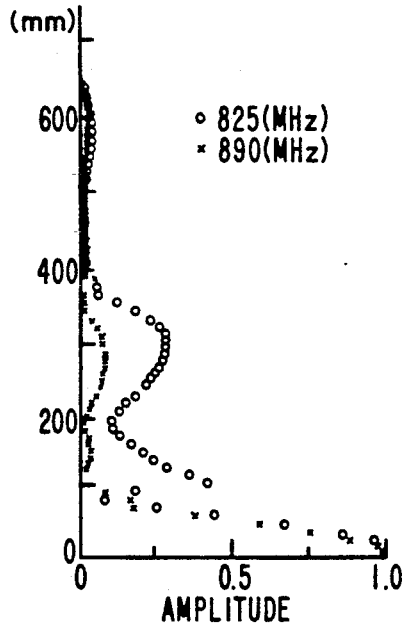

FIGS. 5(*a*) and 5(*b*) respectively show the phase and amplitude of the current distribution of the model antenna shown in FIG. 4. It was measured at 825 MHz. As shown in FIG. 5(*a*) and FIG. 5(*b*), at 825 MHz, the antenna is a kind of collinear array antenna consisted electrically of the part below the sleeve #2.

This current distribution is almost the same in the transmitting frequency range of MT. The current amplitude is very small in the part above the sleeve 1 at 890 MHz as shown in FIG. 3(*b*).

Figure 6:
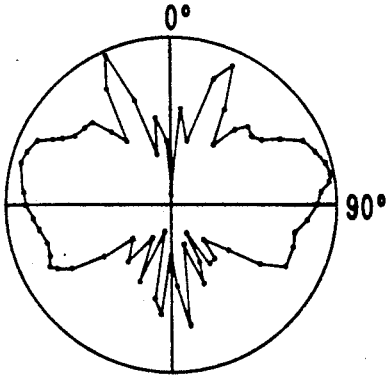
FIG. 6 is the radiation pattern for the model antenna of FIG. 4.

FIG. 6 shows a radiation pattern at a center frequency 835 Mhz in the transmitting frequency range of MT for the model antenna. In the measurement, the antenna was mounted at the center of a ground plane of the diameter of 1.5 meter. The direction of the maximum radiation for the model antenna is close to the horizon. A maximum gain is about 4 dBi.

In the receiving frequency range of MT, the elevation angle of the peak directivity for the model antenna is from 60° to 65°. The directivity for the model antenna is similar to that for a λ/4 monopole antenna.

A voltage standing wave ration (VSWR) is from 1.8 to 2.4 in the transmitting frequency range of MT. In the receiving frequency range of MT, it achieves a VSWR from 2.0 to 5.5 in the measuring frequency 870–883 MHz and 2.0 or less in the measuring frequency 883–890 MHz, respectively.

In the FM B.C. band (88–108 MHz), the double sleeves almost never influence the current distribution. The model antenna operates as a λ/4 monopole antenna. In the FM B.C. band, the model antenna achieves a VSWR from 2.4 to 10.4.

Although we had not measured the characteristics of the model antenna in the AM B.C. band, we may safely assume that the model antenna will operate as a short dipole. Since the wavelength in the AM B.C. band is much longer than that in the FM B.C. band, the sleeves may never influence the characteristics. The model antenna's length is 648 mm, which is long enough for an AM/FM B.C. receiving antenna.

The AM-FM-Cellular mobile telephone tri-band antenna with double sleeves for vehicles has been designed and measured. The radiation patterns and the VSWR of the tri-band antenna were good in the transmitting frequency of MT. In the receiving frequency of MT, the radiation patterns are similar to those for a λ/4 monopole antenna, and the VSWR is good (2.0 or less) in the frequency 883–890 MHz. The antenna has such a length as to make the radiation efficiency enough.

As a sleeve can be made precisely, the antenna with sleeves is suitable for a mass production. A sleeve can be used to realize a tri-band antenna effectively.

We claim:

1. A tri-band antenna for AM/FM broadcast bands and cellular telephone band comprising:

a center conductor having a length of an approximately $\lambda/4$ at a reception frequency of an FM broadcast band;

a first double sleeve surrounding said center conductor, a top end of said first double sleeve being provided at a position N (N = an integer greater than 1) $\lambda/4$ at a transmission frequency of said cellular telephone band below a top end of said center conductor; and a second double sleeve surrounding said center conductor, a top end of said second double sleeve being provided at a position $N \cdot \lambda/4$ at said transmission frequency of said cellular telephone band below said top end of said first double sleeve and at a position $\lambda/4$ at the transmission frequency of said cellular telephone band above a ground plane; and each of said first and second double sleeves having a length of an approximately $N \cdot \lambda/4$ at said transmission frequency of said cellular telephone band and comprising an inner pipe, an outer pipe coaxially surrounding said inner pipe and an insulator provided between said inner and outer pipes, thus shortening the electrical length of said outer pipe; and said first and second double sleeves being coaxially provided with said center conductor with upper ends of said double sleeves opened and lower ends of said inner and outer pipes of the inner and outer pipes electrically shorted together and electrically connected to said center conductor.

2. A tri-band antenna for AM/FM broadcast bands and cellular telephone band according to claim 1, wherein said top end of said second double sleeve is $\frac{3}{4} \cdot \lambda$ at said transmission frequency of said cellular telephone band below said top end of said first double sleeve.

* * * * *